US006740009B1

(12) United States Patent
Hall

(10) Patent No.: US 6,740,009 B1
(45) Date of Patent: May 25, 2004

(54) ROTARY EXERCISE DEVICE

(76) Inventor: Lawrence Hall, 3958 Stone Ridge Dr., Apt. No. 1, Pleasanton, CA (US) 94588

( * ) Notice: Subject to any disclaimer, the term of this patent is extended or adjusted under 35 U.S.C. 154(b) by 33 days.

(21) Appl. No.: 10/305,874

(22) Filed: Nov. 26, 2002

Related U.S. Application Data

(62) Division of application No. 09/596,782, filed on Jun. 19, 2000, now Pat. No. 6,500,097.

(51) Int. Cl.[7] ..... A63B 22/00

(52) U.S. Cl. ..... 482/54; 482/51; 482/69; 434/59

(58) Field of Search ..... 482/51, 54, 69, 482/66, 2; 119/700, 702; 345/164; 434/59

(56) References Cited

U.S. PATENT DOCUMENTS

| | | | | |
|---|---|---|---|---|
| 321,278 | A | | 6/1885 | Clarke et al. |
| 362,291 | A | | 5/1887 | MacKay |
| 554,138 | A | | 2/1896 | Negbaur et al. |
| 641,424 | A | | 1/1900 | Ziebel |
| 685,685 | A | | 10/1901 | Krahenbuhl |
| 883,485 | A | | 3/1908 | Ridgway |
| 1,399,853 | A | | 12/1921 | Ferguson |
| 1,796,437 | A | | 3/1931 | Burger |
| 3,210,634 | A | | 10/1965 | Stern |
| 3,240,947 | A | | 3/1966 | Mas |
| 3,352,426 | A | | 11/1967 | Carlson |
| 3,443,664 | A | | 5/1969 | Frassanito et al. |
| 3,536,324 | A | | 10/1970 | Ahrens |
| 3,711,090 | A | | 1/1973 | Fiedler |
| 3,869,121 | A | | 3/1975 | Flavell |
| 3,903,613 | A | | 9/1975 | Bisberg |
| 4,060,239 | A | | 11/1977 | Pfleiderer et al. |
| 4,084,810 | A | | 4/1978 | Forsman |
| 4,204,673 | A | | 5/1980 | Speer, Sr. |
| 4,389,047 | A | | 6/1983 | Hall |
| 5,125,361 | A | * | 6/1992 | Rowlands ..... 119/700 |
| 5,792,031 | A | | 8/1998 | Alton |
| 5,980,256 | A | | 11/1999 | Carmein |
| 6,500,097 | B1 | | 12/2002 | Hall |
| 6,563,489 | B1 | * | 5/2003 | Latypov et al. ..... 345/164 |

FOREIGN PATENT DOCUMENTS

| | | |
|---|---|---|
| FR | 2 267 702 | 11/1975 |
| GB | 26372 | 3/1913 |
| GB | 277765 | 9/1927 |
| IT | 380005 | 4/1940 |

* cited by examiner

*Primary Examiner*—Stephen R. Crow
(74) *Attorney, Agent, or Firm*—Knobbe, Martens, Olson & Bear LLP

(57) ABSTRACT

A rotary-type exercise device in which the user jogs, runs, or walks within a cylindrical treadwheel. A safety harness attached to a horizontal stationary beam within the treadwheel above the user prevents the user from falling. A remote control baton controls a braking system for braking and selectively varying the rolling resistance of the treadwheel. Another embodiment provides a harness tied to the hull of a space station to simulate gravity when the exercise device is used in an outer-space, gravity-free environment. Additional embodiments include safety rails. Another embodiment forms the treadwheel in two mating semi-cylindrical sections for facilitating transportation and shipping of the treadwheel. An electronic console continuously apprises the user of his horizontal velocity, time, distance and load factor.

10 Claims, 11 Drawing Sheets

ROTARY EXERCISE DEVICE

This is a divisional application of U.S. patent application Ser. No. 09/596,782 filed Jun. 19, 2000 now U.S. Pat. No. 6,500,097 the disclosure of which is incorporated in its entirety herein by reference.

BACKGROUND OF THE INVENTION

My invention described herein relates to significant improvements for rotary exercise devices. An exemplary prior art rotary exercise device is disclosed in my U.S. Pat. No. 4,385,047.

SUMMARY OF THE INVENTION

The present invention provides the advantages of the treadwheel or mill wheel type exercise device while enabling novice runners, elderly runners, and anyone with balance problems to use the treadwheel device for promoting overall cardiovascular and pulmonary fitness. The invention also enhances sprint performance.

In one preferred embodiment of the invention, a safety harness is worn by the user and attached to an overhead horizontal beam. This harness ensures that the user does not fall within or fall out of the rotating exercise wheel should the user lose his balance while exercising. Other embodiments include safety rails for novices and physically challenged users.

The preferred embodiments of the invention further incorporate a wireless handheld controller in the form of a baton. A control button on this baton permits the user to control an electromagnetic brake to provide a selected amount of resistance to the treadwheel to selectively increase or decrease the drag on the treadwheel or to cause it to brake to a stop.

In another embodiment, the safety harness is used to simulate gravity in an outer space environment. In this embodiment, the vest garment is strapped below the bottom of the safety harness to the hull of a space station.

One embodiment of the invention substantially facilitates transporting and shipping by making the exercise wheel in two semi-cylindrical sections. These sections may be easily transported or shipped and quickly and easily assembled on location into a complete treadwheel.

BRIEF DESCRIPTION OF THE DRAWINGS

FIG. 2(*b*) is a side elevational view of the embodiment of FIG. 2(*a*);

DETAILED DESCRIPTION OF THE PREFERRED EMBODIMENT

A detailed description of a rotary exercise device is found in my U.S. Pat. No. 4,389,047. This patent is incorporated by reference in its entirety in this application.

The exercise device described in the '047 patent is an excellent device for athletes. The preferred embodiments of the present invention retain many of the structural and functional features of the '047 device while particularly enabling novices, the elderly or patients with balance problems to enjoy the distinct advantages of the rotary wheel exercise device. Another advantage is that the exercise device of this invention rehabilitates leg and back injuries by virtue of providing a gently rotating running surface. The curved running surface also simulates "hill training" to enhance sprint performance and anaerobic endurance.

Figure 2:
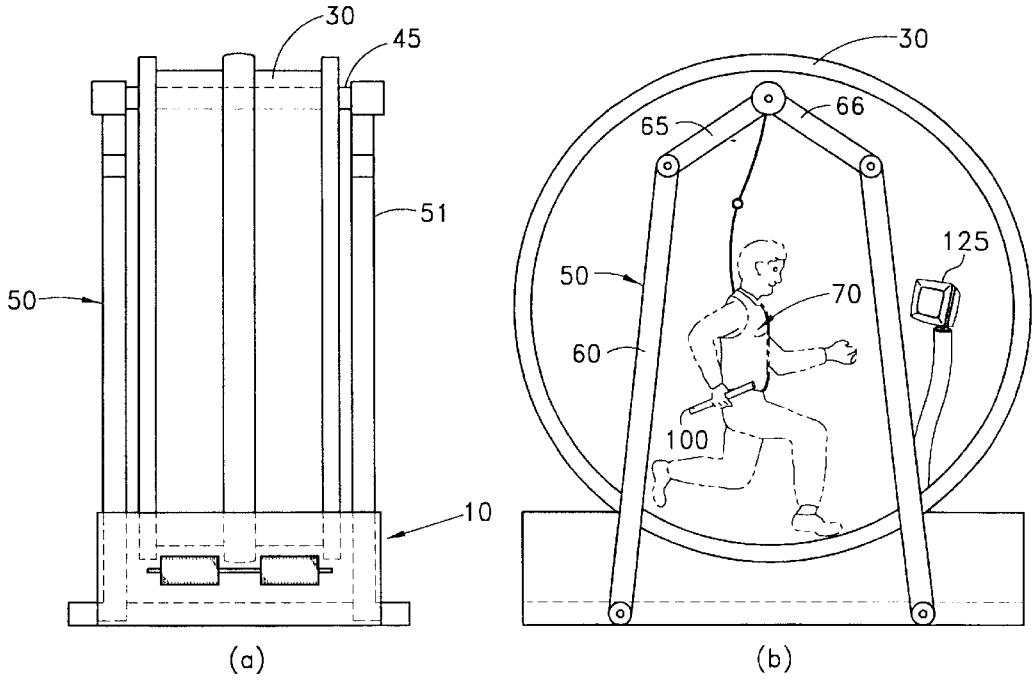
FIG. 2(*a*) is an end elevational view of another embodiment of the invention.
Figure 3:
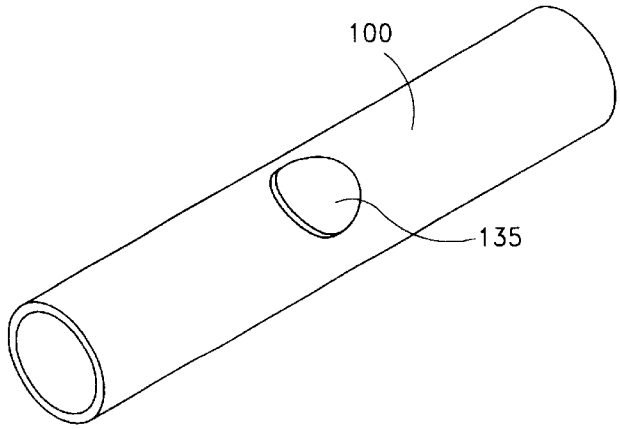
FIG. 3 is a perspective view of the handheld remote control baton that is carried by the person exercising and used for controlling the braking system of the preferred embodiment of the invention.

Referring to the Figures, the preferred embodiments of the invention include a base 10. As shown in FIGS. 2(*a*), 4, 5 and 11, base 10 mounts a plurality of support rollers 20*a*, 20*b*, 21*a*, 21*b*, 22*a*, 22*b*, 23*a*, 23*b* on which freely rotate a cylindrical treadwheel or mill wheel 30. As shown, the axles 32 on which the support rollers rotate are parallel to the axis of the treadwheel 30. The four roller/axle assemblies are spaced along the base to give even support to the treadwheel 30. The roller/axle assemblies are advantageously mounted on pillow blocks 31 at various heights. Each axle has two rollers with a space 25 between them.

Figure 11:
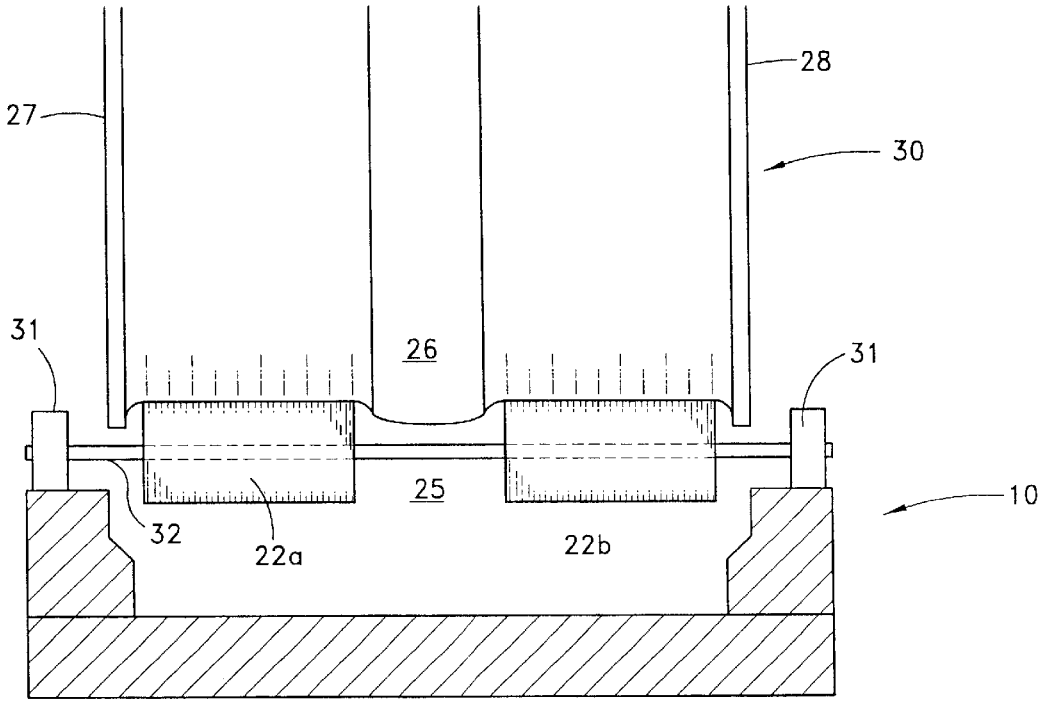
FIG. 11 is a cross-sectional view taken along lines 11—11 of FIG. 4.

Advantageously, as shown in FIG. 11, the treadwheel 30 includes rib 26 and flanges 27, 28. This rib and the flanges provide extra strength for the treadwheel 30. In addition, rib 26 and flanges 27, 28 form a pair of parallel tracks to both prevent the treadwheel 30 from jumping off the support rollers, and keep the treadwheel centered by virtue of the rib 26 which tracks the space 25 between the rollers.

The support roller/axle assemblies advantageously allow for bi-directional rotation of the treadwheel 30. This allows athletes to build the muscles involved in forward and backward running.

Treadwheel 30 is advantageously constructed of a strong, durable lightweight material such as aluminum, fiberglass, or a plastic having these desired properties. The inner surface of the treadwheel 30 advantageously includes a runner 130 of non-skid material, such as rubber, to provide the runner with good footing while using the exercise device. The diameter of the treadwheel is sufficient to allow a normal size adult to walk, run, or jog within the treadwheel 30 to rotate the treadwheel 30. It will be apparent that larger and smaller diameter treadwheels can also be employed in this invention to respectively accommodate exceptionally tall and short adults and children.

Figure 1:
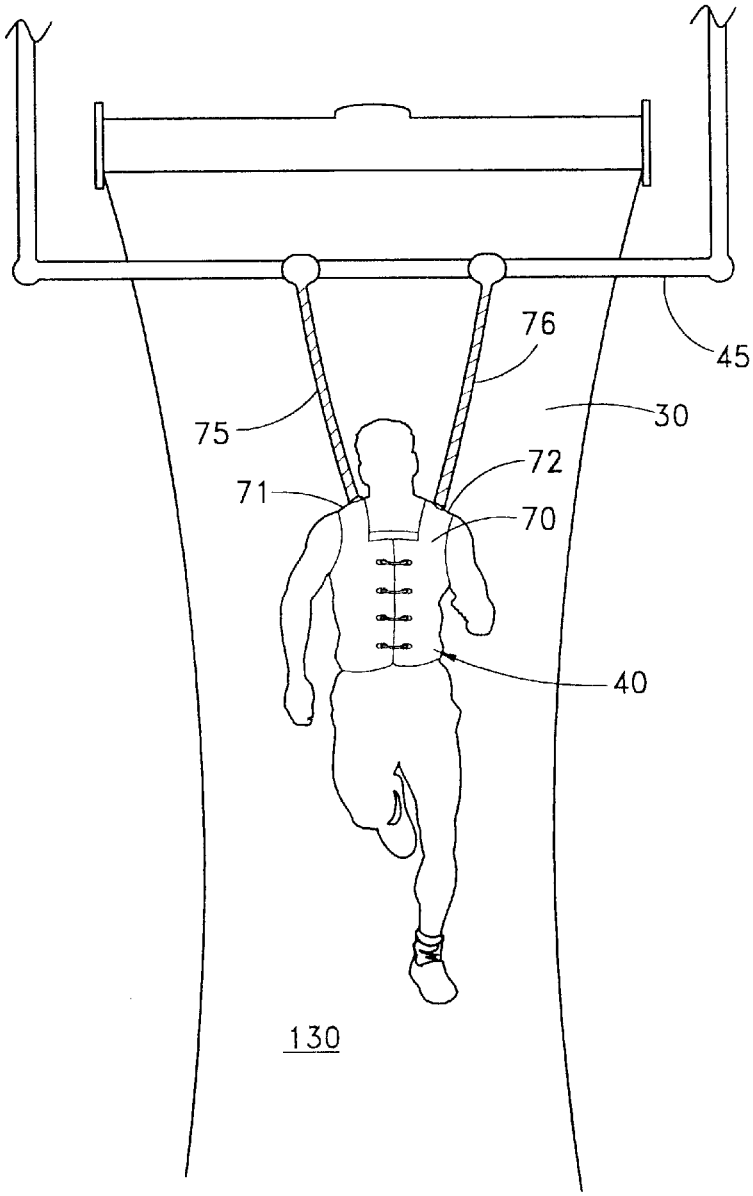
FIG. 1 is a partial sectional perspective view of one embodiment of the invention as seen from within the treadwheel.

An overhead safety harness 40 is attached to a horizontal beam 45 suspended within the interior of mill wheel 30 and above the safety harness and the user. In one embodiment of the invention as shown in FIG. 1, beam 45 is supported from the ceiling of the room in which the rotary exercise device is located. In another embodiment shown in FIGS. 2(*a*) and 2(*b*), beam 45 is supported by stanchion supports 50, 51 located on opposite sides of beam 45. Each of the stanchion supports 50, 51 advantageously include, as shown in FIG. 2(*b*), a pair of generally vertical legs 60, 61 supporting a pair of members 65, 66 joined to form an inverted "V".

A significant feature of this invention is the overhead safety harness 40 shown in FIGS. 1 and 2(*b*). This harness offers particular advantages for novice runners, elderly runners, and anyone with balance problems by preventing the runner from falling if they lose their balance while running within the treadwheel 30. Referring to FIGS. 1 and 2(*b*), the safety harness 40 advantageously includes a vest 70 to fit the individual. The respective shoulder portions 71, 72 of the vest 70 are attached to one end of respective flexible straps 75, 76. The opposite ends of the straps 75, 76 are attached to the overhead horizontal beam 45.

Figure 4:
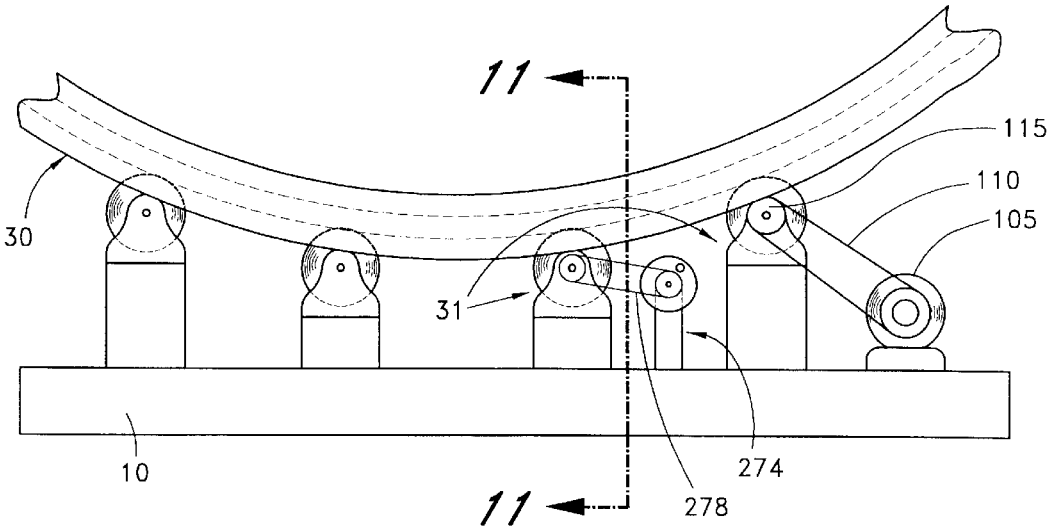
FIG. 4 is a side elevational view showing one embodiment of the braking system of this invention, as well as the support rollers and axle array mounted on the base.
Figure 5:
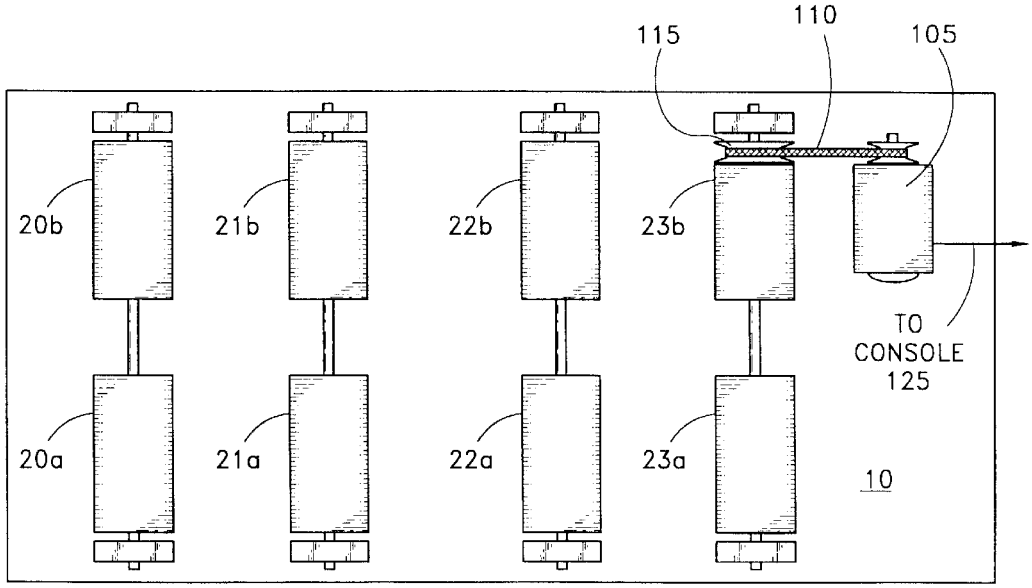
FIG. 5 is a top elevational view of the embodiment of the braking system of FIG. 4, with the rotary exerciser mill wheel removed.

Another significant feature of the invention is a braking system advantageously controlled by a hand-held baton 100 (see FIGS. 2(*b*) and 3) that remotely controls an electromagnetic clutch 105 shown in FIGS. 4 and 5. As shown, clutch 105 is attached by a belt 110 to a pulley 115 attached to support rollers 23*a*, 23*b*. It will be apparent that other embodiments of the invention include drives other than a belt for coupling the clutch 105 to one or more of the support rollers. During the exercise workout, the clutch provides a selectively variable resistance to build the user's muscle mass and power.

In still another embodiment not shown, a motor is coupled to the support rollers 23*a* and 23*b* so that the support rollers are both driven and braked to provide a controllable driven running surface.

Baton 100 incorporates a transmitter of wireless radio frequency or light waves (such as nonvisible infrared signals) to a console controller unit 125 supported by the base 10 (see FIG. 2(*b*)). Advantageously, console 125 responds both to commands entered into its entry pad and to wireless signals received from baton 100. Console 125 is connected to clutch 105 to provide the requisite control over the braking force applied by this device. Clutch 105 responds to control signals from console 125 to provide a controlled resistance and a controlled brake for the treadwheel 30 by providing a controlled braking torque to rollers 23*a* and 23*b* which, in turn, apply a braking drag on the mill wheel 30.

A typical workout routine using the invention and baton control 100 is as follows:

1. The user sets up a workout program on console 125 shown in FIG. 2(*b*).
2. Signals from the console 125 cause clutch 105 to fully engage to place a treadwheel 30 in an initial braked condition.
3. The user then gets onto the inside circular treadmill track 130 of mill wheel 30.
4. The user then actuates a control button 135 on baton 100 which sends wireless lightwave or RF signals to console 125 to release clutch 105.
5. The user controls the speed and resistance of the treadwheel by actuating button 135 one or more times to signal the clutch 105 to apply greater or less resistance to rotation of the treadwheel 30.
6. In an emergency, the baton 100 control can be used to the clutch 105 to brake and thus prevent rotation of treadwheel 30. In one embodiment, continuously pressing down on the button 135 will brake the treadwheel. In an alternative embodiment, button 135 must be continuously depressed to turn off the braking force on treadwheel 30. This latter embodiment has the advantage that in a panic, the user need only drop the baton to release pressure on button 135 thus causing clutch 105 to brake automatically treadwheel 30.

Figure 6:
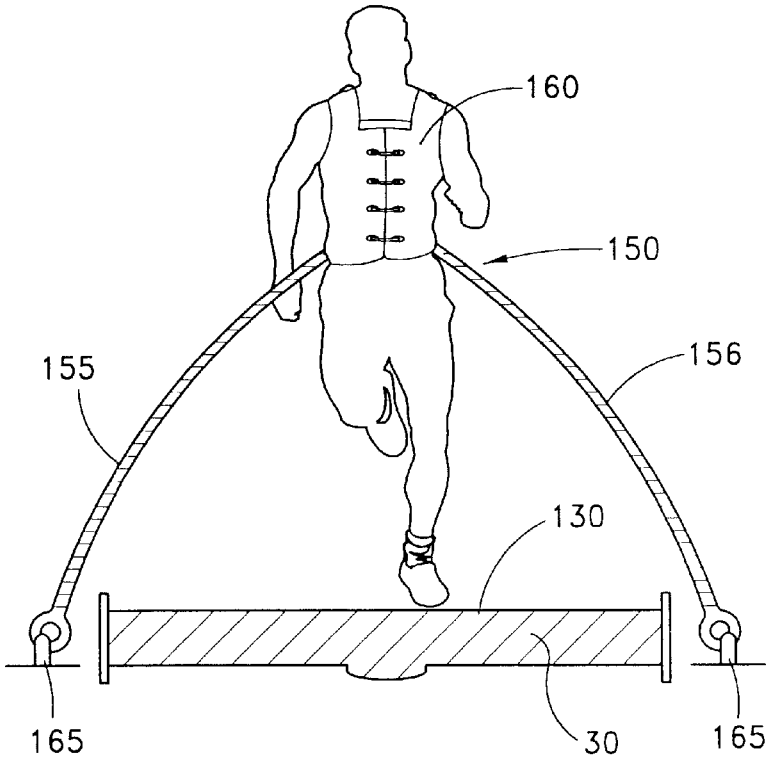
FIG. 6 is a partially sectioned view of another embodiment of the safety harness of this invention wherein the rotary exerciser device is to be located in an outer space location with the vest secured by bungee cords to produce "artificial gravity"

Another embodiment of the invention is shown in FIG. 6. This embodiment has particular utility in the gravity-free environment of space, such as the space station currently being constructed by NASA. The treadwheel with running track 130 would be installed in the space station. Safety harness 150 is then used to simulate the force of gravity on earth. Flexible bungee-like cords 155, 156 attached to opposite bottom sides of the vest 160 are connected below the vest 160 to the hull 165 of the space station producing artificial gravity.

Figure 7:
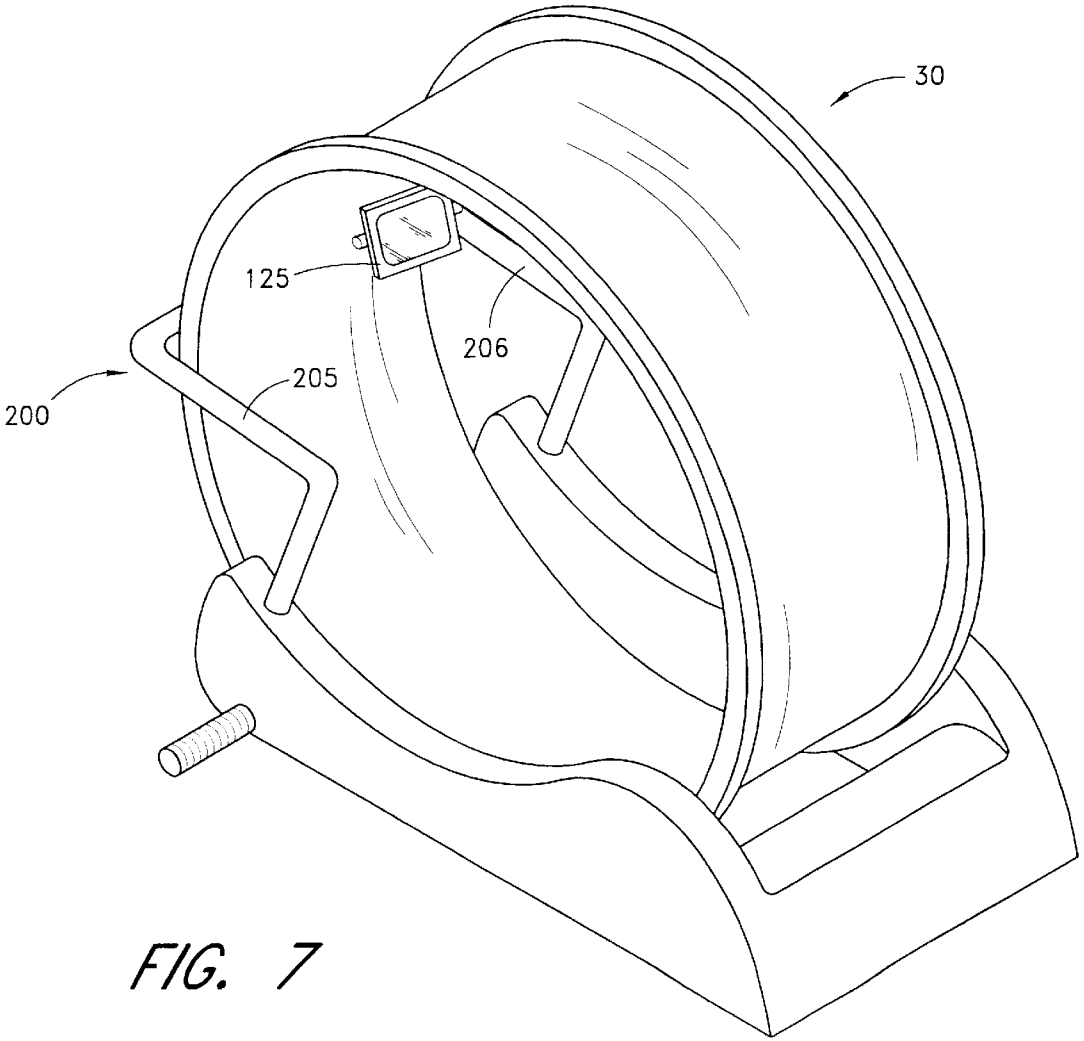
FIG. 7 is a perspective view of another embodiment of the invention showing a parallel bar safety rail.
Figure 8:
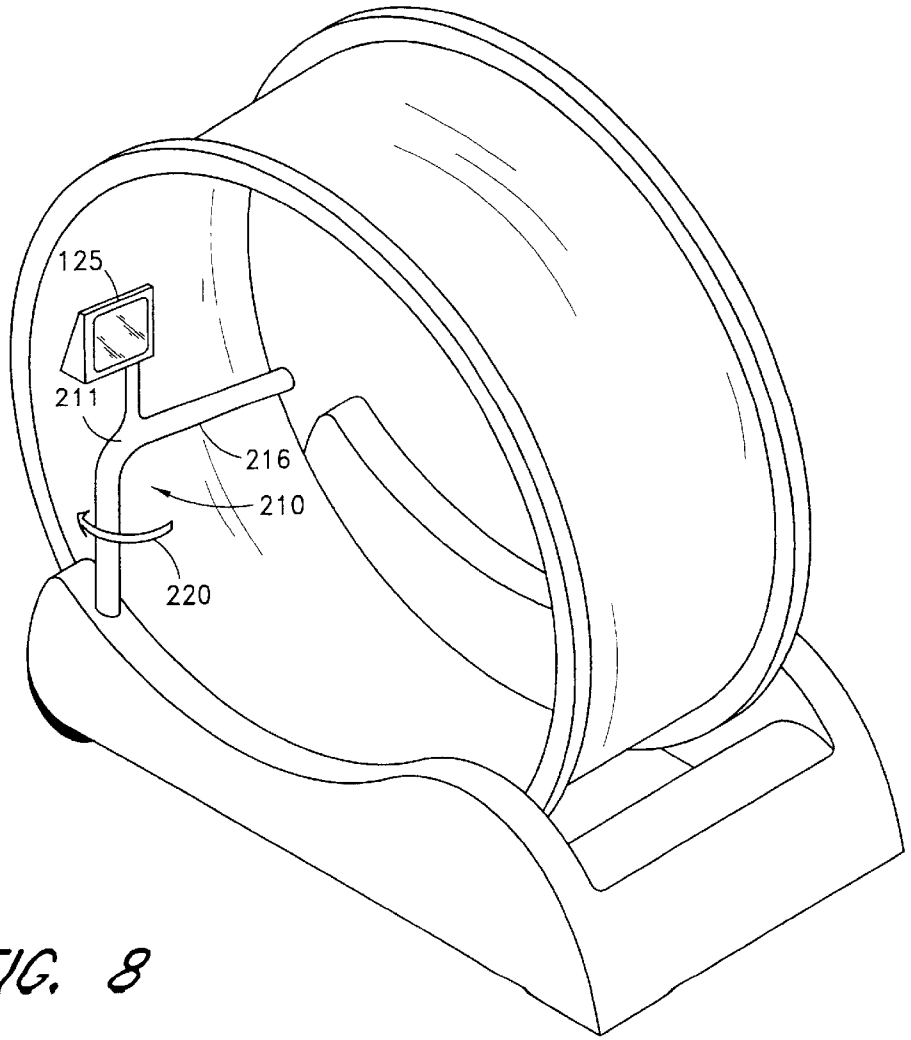
FIG. 8 is a perspective view of another embodiment of the invention showing an L-shaped bar safety rail, the console being located off to one side so that user may easily grasp the safety bar.

FIGS. 7 and 8 illustrate two embodiments of rotary exercising devices having safety rails. These rails may be provided both on exercise devices having the safety harness already installed and an exercise device, as shown in FIGS. 7–8 that does not have a safety harness. In FIG. 7, the safety rail 200 is formed by two parallel bars 205, 206 located on opposite sides of the treadwheel 30. The console 125 is advantageously supported by one of the parallel bars.

In the embodiment of FIG. 8, the safety bar 210 is formed by an L-shaped member 211 having one end rotatably mounted to the base 215 of the rotary exercise device. In the position shown in FIG. 8, the cantilever horizontal bar 216 is positioned in front of the runner with the console advantageously attached at one side of the horizontal bar 216 so that the user may easily grasp the safety bar. Rotation of this bar in the clockwise direction of arrows 220 moves both this bar 216 and console 120 to be swiveled out of the way of the runner.

Figure 9:
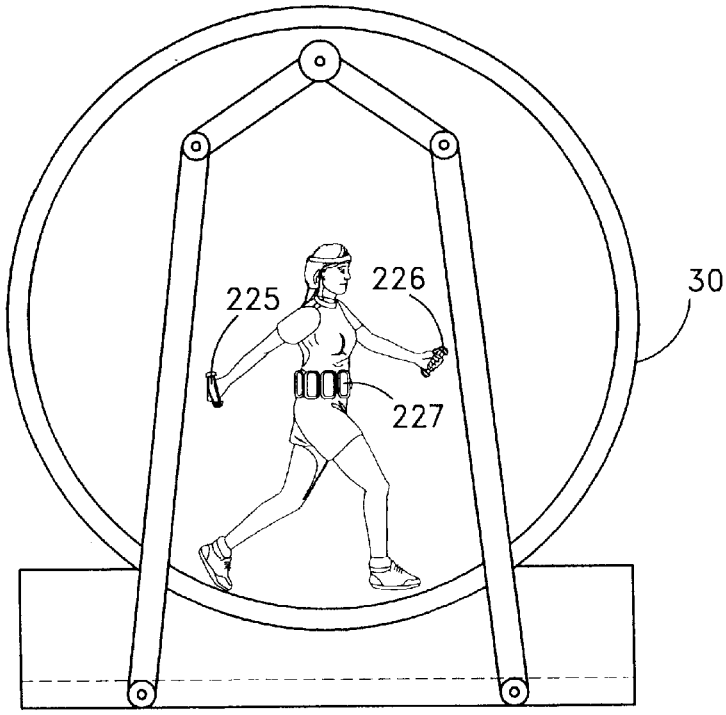
FIG. 9 is a side elevational view illustrating utilizing the invention for weight training.

A feature of rotary exercise devices constructed in accordance with this invention is that they facilitate building leg muscle mass and power. Enhanced exercise is achieved by weight training exercising, in which, as shown in FIG. 9, the runner can both hold hand weights 225, 226 and wear a weighted belt 227.

Figure 10:
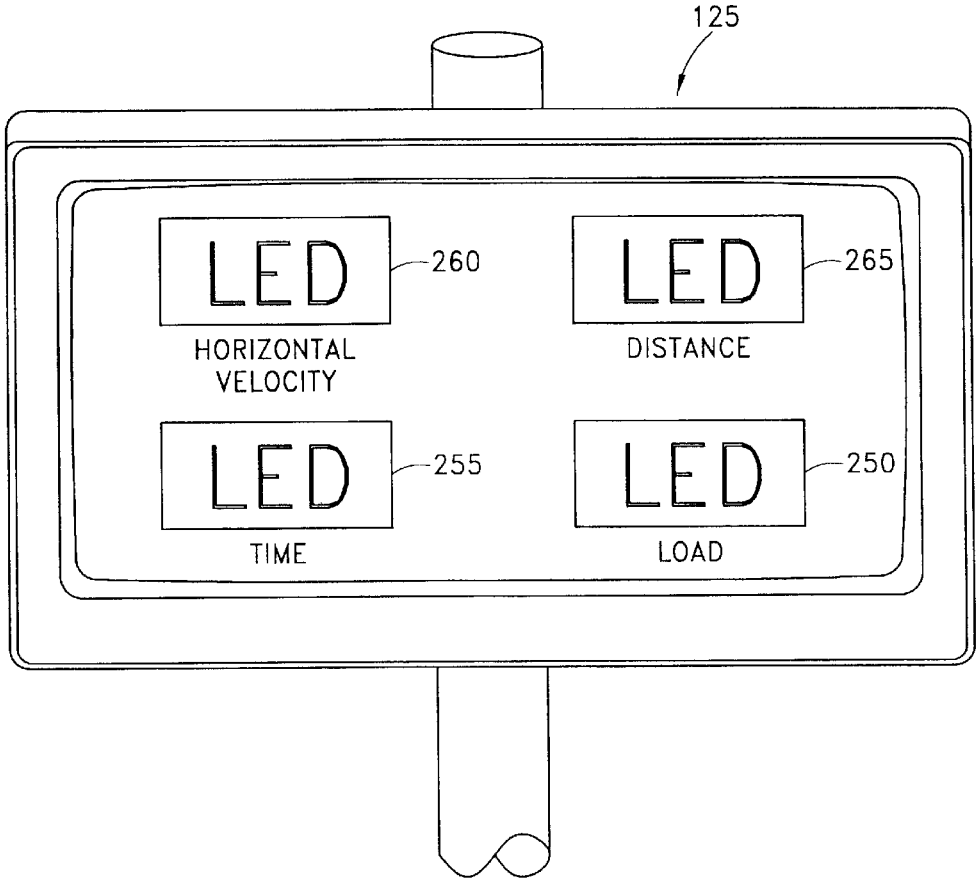
FIG. 10 is a side elevational view illustrating one embodiment of the read-out provided at the console.

The console 125, shown in detail in FIG. 10, advantageously includes four LED or similar read-outs showing the load factor selected by the user on read-out 250, the duration of the exercise shown on read-out 255, the speed of the runner on read-out 260, and the distance traveled by the runner on read-out 265. This information, particularly the substantially instantaneous readout of velocity, provides the "biofeedback" information needed by the runner in order to improve his or her stride technique and sprint performance. Also, a coach or trainer standing by, may give sprint technique instruction to an athlete while he or she is running full speed. In one embodiment of the invention, the console includes a computer which is programmable to provide a programmed workout in the exercise device.

Figure 14:
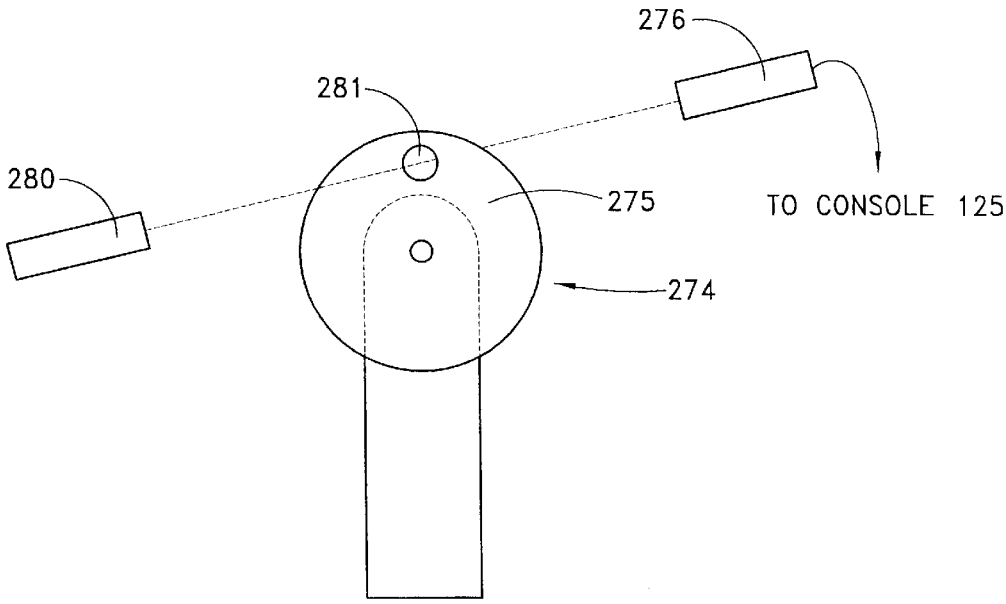
FIG. 14 illustrates one embodiment of a transducer for providing velocity and distance signals to the console. The transducer and electromagnetic clutch wheels are one in the same.

One embodiment of a transducer 274 for supplying the velocity and distance signal to the console 125 is shown in FIGS. 4 and 14 in which a pulley 275 is rotated by a belt 27 connected to a support roller. Each rotation of the pulley 275 translates into a signal pulse by virtue of infrared light source 280 and an infrared responsive detective 276. This pulse is produced once each rotation when aperture 281 in pulley 275 is in alignment with source 280 and detector 276. In one embodiment, the transducer 274 is independent of the electromagnetic clutch as shown, for example, in FIG. 4. However, it will be apparent that in another embodiment of the invention, the transducer can, instead, be combined as part of the clutch so that each rotation of the clutch is detected for velocity and distance rather than using a separate transducer wheel 275 for this purpose.

Figure 13:
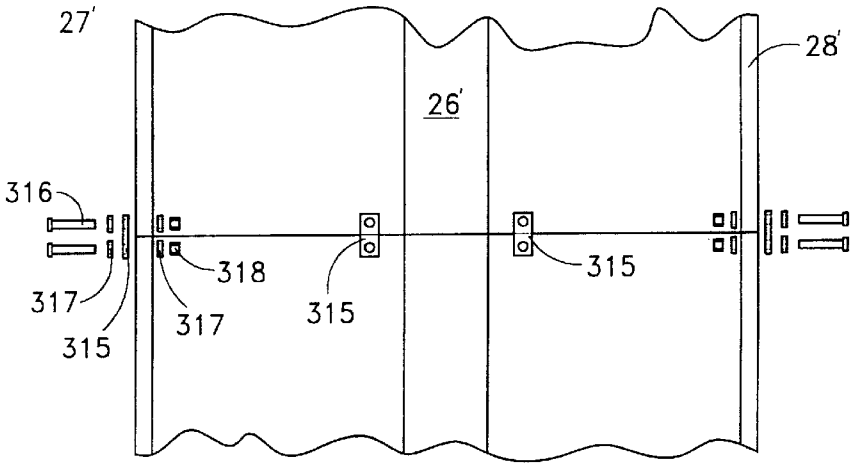
FIG. 13 is a partially exploded bottom view of the treadwheel shown in FIG. 12.
Figure 12:
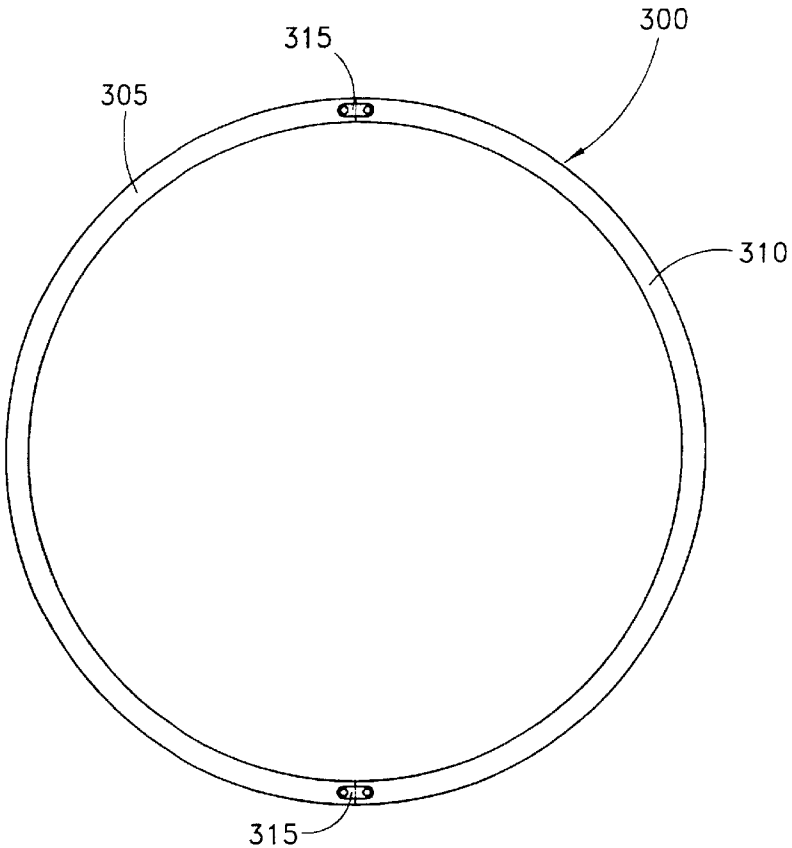
FIG. 12 is a side elevational view of a two-piece treadwheel.

An additional embodiment of this invention enables the treadwheel to be disassembled into two halves that are more easily shipped or transported. In this embodiment, treadwheel 300 is formed in two semi-cylindrical sections 305 and 310 and joined, as shown in FIGS. 12 and 13, by metal plates 315, bolts 316, washers 317 and nuts 318. Alternatively, two-piece toggle clamps mounted on the outer flanges of the treadwheel halves can be used to quickly release and clamp together the mating sections 305, 310. In addition, mating joints in the form of dowels or pins in one half section 305 can be used to fit into mating holes of the abutting section half 310 to provide aligned mating sections and prevent motion or slipping of the sections 305, 310 after their assembly. Assembly of the treadwheel 300 is accomplished quickly and easily and the resultant complete treadwheel has, as shown, the outer flanges 27', 28' and rib 26' of the one-piece treadwheel 30 described above, so that this assembled treadwheel 300 functions in an identical manner to the one-piece wheel.

What is claimed is:

1. A rotary exercising device having a wireless control for braking and selecting the degree of exercise resistance, comprising:

cylindrical lightweight treadwheel of a size sufficient to allow a normal-sized adult to run within said treadwheel to rotate said treadwheel;

support rollers having axes parallel to the axis of said treadwheel, said support rollers being rotatably mounted so that said treadwheel rotates freely upon said support rollers;

a base mounting said support rollers and said treadwheel without interfering with the rotation of said treadwheel and said support wheels;

a handheld baton;

a signal transmitter in said baton;

a console;

a stationary signal receiver operatively coupled to said console;

an electromagnetic clutch responsibly coupled to said console; and a belt drive connecting said clutch to one of said support rollers.

2. The exercising device of claim 1, for use in a gravity-free embodiment, further comprising a flexible restraining strap and wherein one end of the flexible restraining strap is connected to a member above the user's head.

3. The exercising device of claim 1, for use in a gravity-free environment, further comprising a flexible restraining strap and wherein one end of flexible restraining strap is connected to a member the user's head.

4. The exercising device of claim 1, wherein the clutch is configured as a brake and wherein releasing the baton actuates the brake.

5. The exercising device of claim 4, further comprising a button on the baton, and wherein depressing the button releases the brake and releasing the button engages the brake.

6. The exercising device of claim 1, further comprising a grab rail extending from the base within said treadwheel.

7. The exercising device of claim 6, wherein said grab rail is pivotally attached to the base such that the rail can be selectively positioned relative to the treadwheel.

8. The exercising device of claim 1, further comprising a detector coupled to the device for detecting operating parameters of the device.

9. The exercising device of claim 8, further comprising a signal transmitter coupled to the detector and configured to receive an input from said detector and send the signal to the console based upon the input from the detector.

10. An exercise device that (a) assists the user to maintain their balance while walking or running for exercise, and (b) provides a wireless control for braking and selecting the degree of exercise resistance, said device comprising:

a cylindrical lightweight treadwheel of a size sufficient to allow a normal-sized adult to run within said treadwheel to rotate said treadwheel;

support rollers having axes parallel to the axis of said treadwheel, said support rollers being rotatably mounted so that said treadwheel rotates freely upon said support rollers;

a base mounting said support rollers and said treadwheel without interfering with the rotation of said treadwheel and said support rollers;

a vest-type safety harness worn by the user;

a plurality of stanchion supports attached to said base on opposite sides of said treadwheel;

a horizontal beam supported by said stanchion supports above the head of the user;

at least two flexible straps respectively connected between shoulder portions of said safety harness and said horizontal beam;

a safety rail located sufficiently close to the user so that the user can grab said safety rail;

a handheld baton;

a signal transmittable from said baton;

a stationary signal receiver operatively coupled to an electromagnetic clutch; and a drive connecting said clutch to at least one of said support rollers.

* * * * *

UNITED STATES PATENT AND TRADEMARK OFFICE

CERTIFICATE OF CORRECTION

PATENT NO. : 6,740,009 B1
DATED : May 25, 2004
INVENTOR(S) : Lawrence Hall

It is certified that error appears in the above-identified patent and that said Letters Patent is hereby corrected as shown below:

Title page,
Item [75], Inventor, (second inventor) should read -- Milton Velinsky, Palm Beach, FL (US) --
Item [73], Assignee, should read -- Lawrence Hall, Pleasanton, CA (US) --

Signed and Sealed this

Fourth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,740,009 B1
APPLICATION NO. : 10/305874
DATED : May 25, 2004
INVENTOR(S) : Lawrence Hall et al.

It is certified that error appears in the above-identified patent and that said Letters Patent is hereby corrected as shown below:

In Column 5, Line 39, in Claim 1, before “cylindrical”, please insert --a--.

In Column 6, Line 5, in Claim 3, after “of”, please insert --said--.

In Column 6, Line 6, in Claim 3, after “member”, please insert --below--.

Signed and Sealed this

Second Day of January, 2007

JON W. DUDAS
*Director of the United States Patent and Trademark Office*